US008259032B1

(12) United States Patent
Buckley

(10) Patent No.: US 8,259,032 B1
(45) Date of Patent: Sep. 4, 2012

(54) METAMATERIAL AND FINGER SLOT FOR USE IN LOW PROFILE PLANAR RADIATING ELEMENTS

(75) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 500 days.

(21) Appl. No.: 12/556,126

(22) Filed: Sep. 9, 2009

(51) Int. Cl.
*H01Q 15/02* (2006.01)
*H01Q 1/40* (2006.01)

(52) U.S. Cl. ..... 343/909; 343/873

(58) Field of Classification Search ..... 343/793, 343/795, 776, 909, 700 MS, 872, 873
See application file for complete search history.

(56) References Cited

U.S. PATENT DOCUMENTS 6,842,140 B2 * 1/2005 Killen et al. ..... 343/700 MS
7,889,127 B2 * 2/2011 Sajuyigbe et al. ..... 342/372
2008/0129626 A1 * 6/2008 Wu et al. ..... 343/767

* cited by examiner

*Primary Examiner* — Jacob Y Choi
*Assistant Examiner* — Robert Karacsony
(74) *Attorney, Agent, or Firm* — Donna P. Suchy; Daniel M. Barbieri

(57) ABSTRACT

An array antenna may include a substrate, an array of metamaterial elements including radiating elements suspended in the substrate and integrated with the array of dipoles, where the metamaterial elements include a first metal layer and a second metal layer connected by a via, an array of dipoles, a groundplane coupled with a first side of the substrate, the ground plane having a symmetric slot aperture and not contacting the array of metamaterial elements, and a stripline feed for the radiating elements, where the stripline feed passes from a groundplane first side through the symmetric slot aperture to a groundplane second side.

11 Claims, 5 Drawing Sheets

METAMATERIAL AND FINGER SLOT FOR USE IN LOW PROFILE PLANAR RADIATING ELEMENTS

TECHNICAL FIELD

The present invention generally relates to the field of metamaterials and more particularly to a metamaterial utilized in low profile radiating elements.

BACKGROUND

An antenna or other receiver may include a transducer designed to transmit or receive electromagnetic waves. Antennas may convert electromagnetic waves into electrical currents and electrical currents into electromagnetic waves. An antenna may have a physical structure including an arrangement of conductors that generate a radiating electromagnetic field in response to an applied alternating voltage and the associated alternating electric current. Additionally, an antenna may be placed in an electromagnetic field so that the field will induce an alternating current in the antenna and a voltage between its terminals. Antennas often may utilize radiating elements capable of transmitting and/or receiving electromagnetic energy.

Metamaterials may include materials designed to have magnetic or electric resonances. Generally, a metamaterial may have structural features smaller than the wavelength of the electromagnetic radiation with which it interacts. Additionally, metamaterials may include artificial materials constructed into arrays of current-conducting elements with suitable inductive and capacitive characteristics. Further, a metamaterial may have a negative refractive index.

When an electromagnetic wave interacts with a metamaterial, the metamaterial interacts with the electric and magnetic fields of the electromagnetic wave. These interactions may include altering the electromagnetic wave, such as bending or absorbing light.

SUMMARY

The present disclosure is directed to components in an array antenna utilizing metamaterial elements including radiating elements suspended in a substrate.

A metamaterial radiating element suspended in a substrate configured for use in an array antenna may include a top or first metal layer and a bottom or second metal layer where each layer may include at least one metamaterial radiating element and/or at least one dipole. The second planar layer of metal may be substantially parallel to the first planar layer of metal. A substrate may be configured to support the layers and/or array of metamaterial radiating elements and dipoles. Additionally, an array antenna may include an array of at least one metamaterial radiating element and at least one dipole, a substrate, and a ground plane layer having a finger slot aperture.

An integrated-design embedded radiating element array antenna may include a radome layer, a substrate, an array of metamaterial radiating elements and dipoles suspended in the substrate, where the metamaterial elements and dipoles include a first metal layer and a second metal layer, a ground plane coupled with a first side of the substrate, the ground plane having a finger slot aperture and not contacting the array of metamaterial elements, and/or a stripline feed for the radiating elements, where the stripline feed passes from a groundplane first side through the finger slot aperture to a ground plane second side.

It is to be understood that both the foregoing general description and the following detailed description are exemplary and explanatory only and are not restrictive of the invention claimed. The accompanying drawings, which are incorporated in and constitute a part of the specification, illustrate an example of the invention and together with the general description, serve to explain the principles of the technology.

BRIEF DESCRIPTION OF THE DRAWINGS

The numerous objects and advantages of the present technology may be better understood by those skilled in the art by reference to the accompanying figures in which.

DETAILED DESCRIPTION

Figure 1:
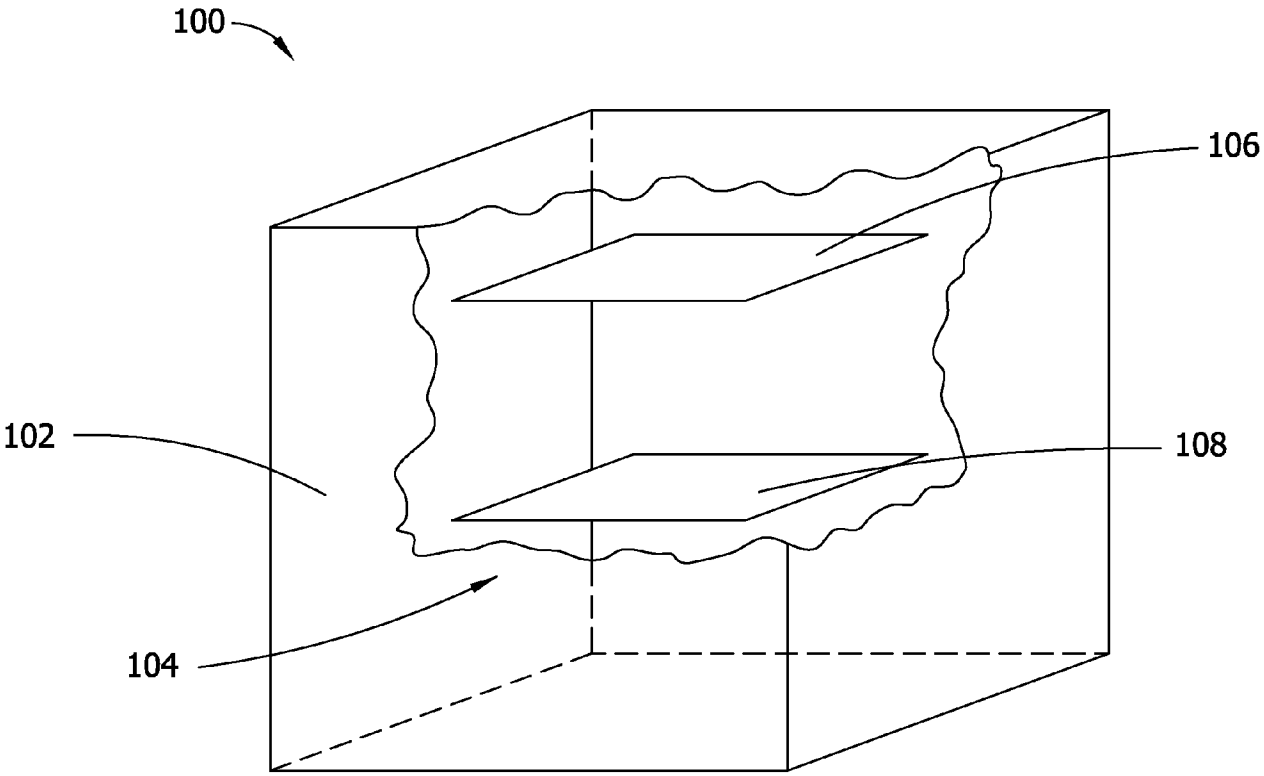
FIG. 1 is a partial isometric view illustrating a metamaterial radiating element.

The following discussion is presented to enable a person skilled in the art to make and use the present teachings. Various modifications to the illustrated examples will be readily apparent to those skilled in the art, and the generic principles herein may be applied to other examples and applications without departing from the present teachings. Thus, the present teachings are not intended to be limited to examples shown, but are to be accorded the widest scope consistent with the principles and features disclosed herein. The following detailed description is to be read with reference to the figures, in which like elements in different figures have like reference numerals. The figures, which are not necessarily to scale, depict selected examples and are not intended to limit the scope of the present teachings. Skilled artisans will recognize the examples provided herein have many useful alternatives and fall within the scope of the present teachings.

Reference will now be made, in detail, to embodiments of the invention. Additional details of the invention are provided in the examples illustrated in the accompanying drawings.

Referring generally to FIG. 1, one depiction of a metamaterial radiating element suspended in a substrate 100 is illustrated. The metamaterial radiating element 104 may include a top metal layer 106, and a bottom metal layer 108.

A metamaterial may include an electromagnetically continuous structure comprising subwavelength molecules with tailorable permittivity and permeability. Permittivity may include how an electric field affects and is affected by a dielectric medium. Permeability may be determined by the ability of a material to polarize in response to the electric field, and thereby reduce the total electric field inside the material. A metamaterial radiating element 104 may have a dimension less than or equal to one signal wavelength. In one embodiment, a metamaterial radiating element 104 may have a dimension half of one signal wavelength.

A metamaterial radiating element 104 may include a top metal layer 106 and/or a bottom metal layer 108. The top metal layer 106 and bottom metal layer 108 may be substantially planar and may be substantially parallel to each other. The top metal layer 106 and the bottom metal layer 108 may include any suitable metal and/or conductive material, such as aluminum or copper. In one embodiment, as illustrated in FIG. 1, the top metal layer 106 and the bottom metal layer 108 may be substantially planar and parallel while not being in direct contact with each other. The metamaterial radiating element suspended in a substrate 100 must be configured to not connect to a ground plane 602. Further, the metamaterial radiating element 104 may be scalable in frequency.

A substrate 102 may include a nonconducting substance, dielectric, and/or insulator. A substrate 102 may include a dielectric material, such as a micro dispersed ceramic PTFE composite utilizing a woven fiberglass reinforcement. One example of a suitable substrate 102 may include an Arlon CLTE laminate, available from Arlon Inc., Santa Ana, Calif. Another example of a suitable substrate 102 may include Rogers 6002 available from the Rogers corporation, Rogers, Conn. Additionally, the substrate 102 may meet certain quality standards, such as a MIL-STD-810E standard. The MIL-STD-810 series of standards are issued by the United States Army's Developmental Test Command for specifying various environmental tests. In one example, substrate 102 may meet a MIL-STD-810E Method 509.3 standard for salt fog corrosion resistance.

Figure 2:
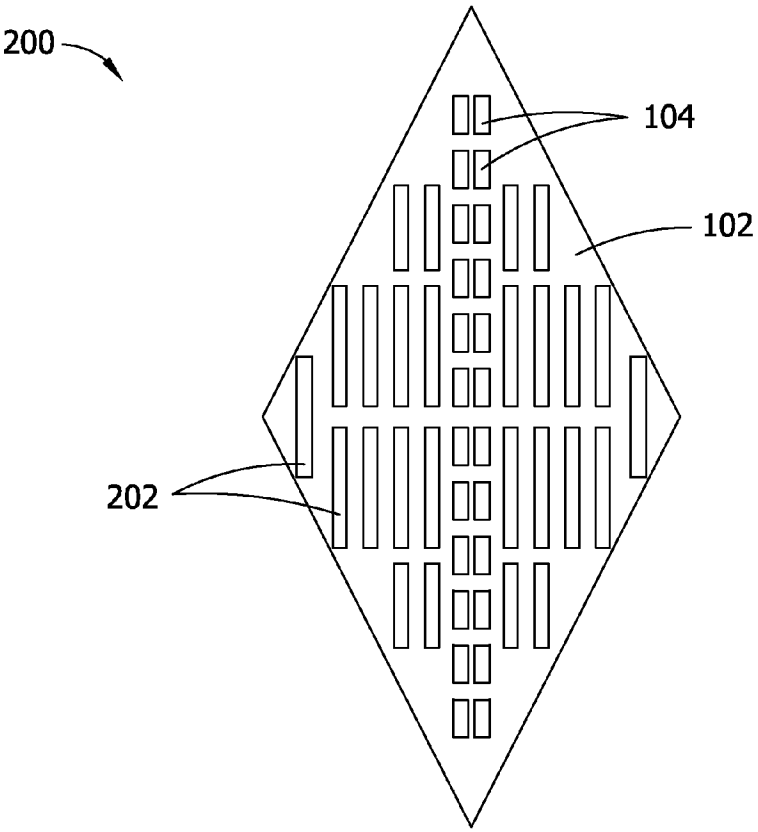
FIG. 2 is a top plan view illustrating a first level of an array of metamaterial radiating elements and dipoles suspended in a substrate.
Figure 3:
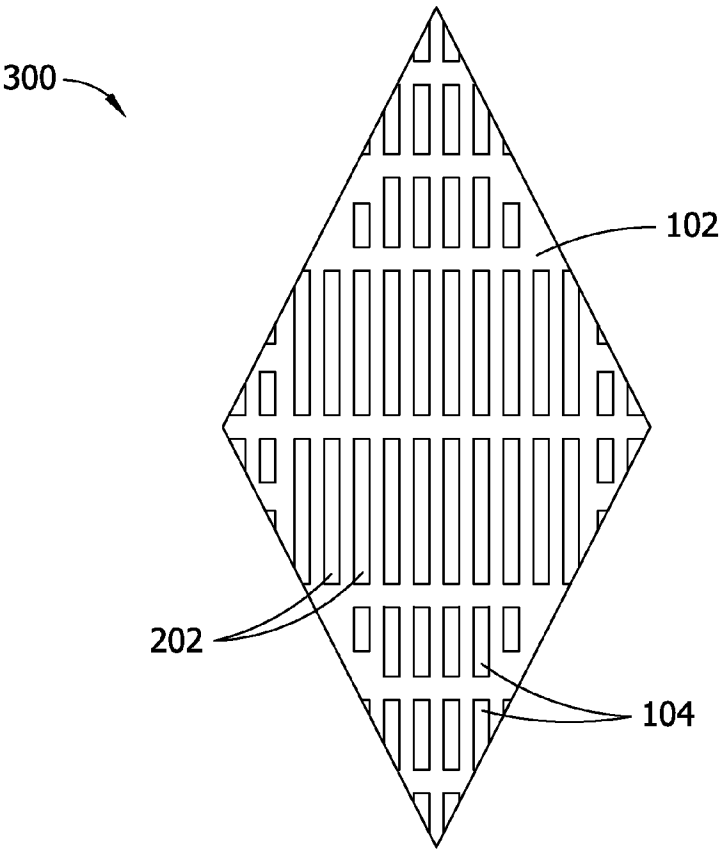
FIG. 3 is a top plan view illustrating a second level of an array of metamaterial radiating elements and dipoles suspended in a substrate.

Referring generally to FIGS. 2 and 3, a first level 200 and a second level 300 of a dipole and metamaterial radiating element array are illustrated. The first level 200 and the second level 300 of the dipole and metamaterial radiating element array may include a plurality of metamaterial radiating elements 104 suspended in a substrate 102. Additionally, the plurality of metamaterial radiating elements 104 and/or dipoles 202 may be arranged in a non-uniform and/or an inhomogeneous arrangement. One example of a non-uniform arrangement in a single layer may include a first metamaterial radiating element 104 located a certain distance from a second metamaterial radiating element 104 and located a different distance from a third metamaterial radiating element 104. This non-uniform arrangement may apply to each and/or only a portion of metamaterial radiating elements 104 and/or dipole 202 array. Additionally, the first level 200 and the second level 300 may include different arrangements of dipole 202 and/or metamaterial radiating element 104 arrangements.

Further, each metamaterial radiating element 104 may be surrounded only by the substrate 102 and may not contact the ground plane 402. In some instances, a metamaterial radiating element suspended in a substrate 100 may include multiple layers of metamaterial radiating elements 104, dipoles 202, and/or substrate 102. In one embodiment, an array antenna may include a second level 300 and a first level 200 of metamaterial radiating elements 104 and dipoles 202, where the upper level 300 array of metamaterial radiating elements 104 and dipoles 202 is arranged differently than the first level 200 of metamaterial radiating elements 104 and dipoles 202. This different arrangement of metamaterial radiating elements 104 and dipoles 202 between the second level 300 and first level 200 may serve to increase the capability to tune the radiating element of an antenna. Additionally, the different arrangement may reduce the cost and increase the yield by not requiring the use of a via for connecting a top metal layer 106 and a bottom metal layer 108.

Figure 4:
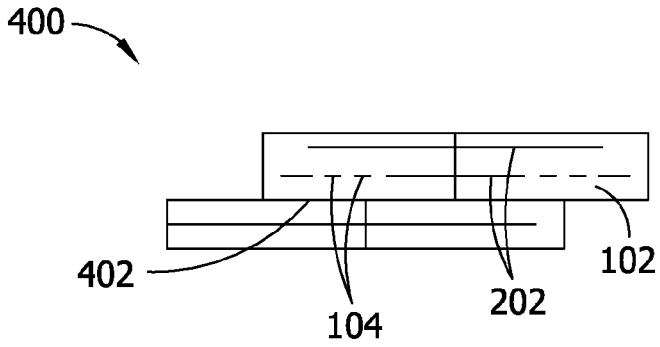
FIG. 4 is a partial cross-sectional view illustrating an exemplary array antenna utilizing metamaterial radiating elements.

Referring generally to FIG. 4, a cross-sectional view of one embodiment of a metamaterial loaded wide scan radiating element 400 is illustrated. A metamaterial loaded wide scan radiating element 400 may include at least one layer including a metamaterial radiating element 104 and dipole array 202 disposed in a substrate 102. Additionally, a metamaterial loaded wide scan radiating element 400 may include a ground plane 402. A ground plane 402 may include a structure, such as a flat piece of metal, located between an antenna and another object. A ground plane 402 may be designed to limit the downward radiation of an antenna and may include a flat, curved, and/or other functionally-shaped conducting material. In one embodiment, a metamaterial loaded wide scan radiating element 400 may include a nonuniformly distributed array of metamaterial radiating elements 104 and dipoles 202 suspended in a substrate 102 and a planar ground plane 402. Additionally, a metamaterial loaded wide scan radiating element 400 may include more than one ground plane 402.

Figure 5:
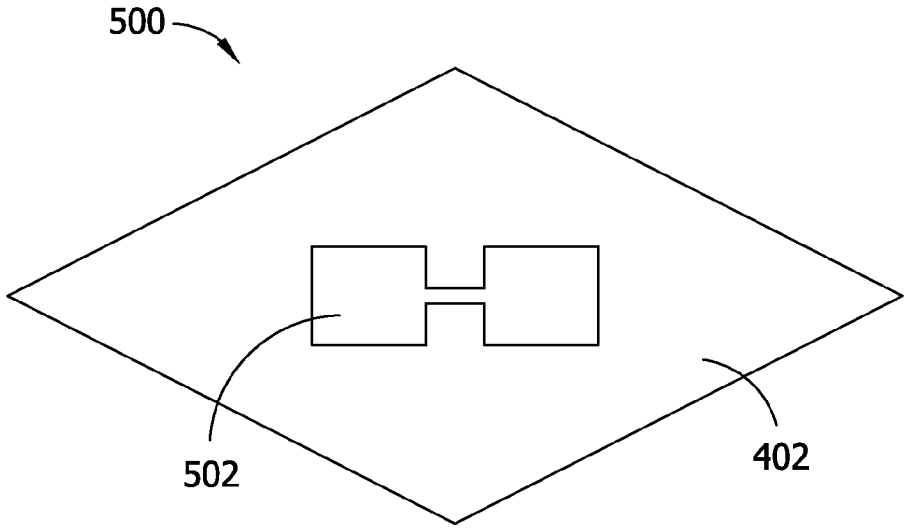
FIG. 5 is a partial top plan view illustrating a ground plane having a finger slot aperture.
Figure 6:
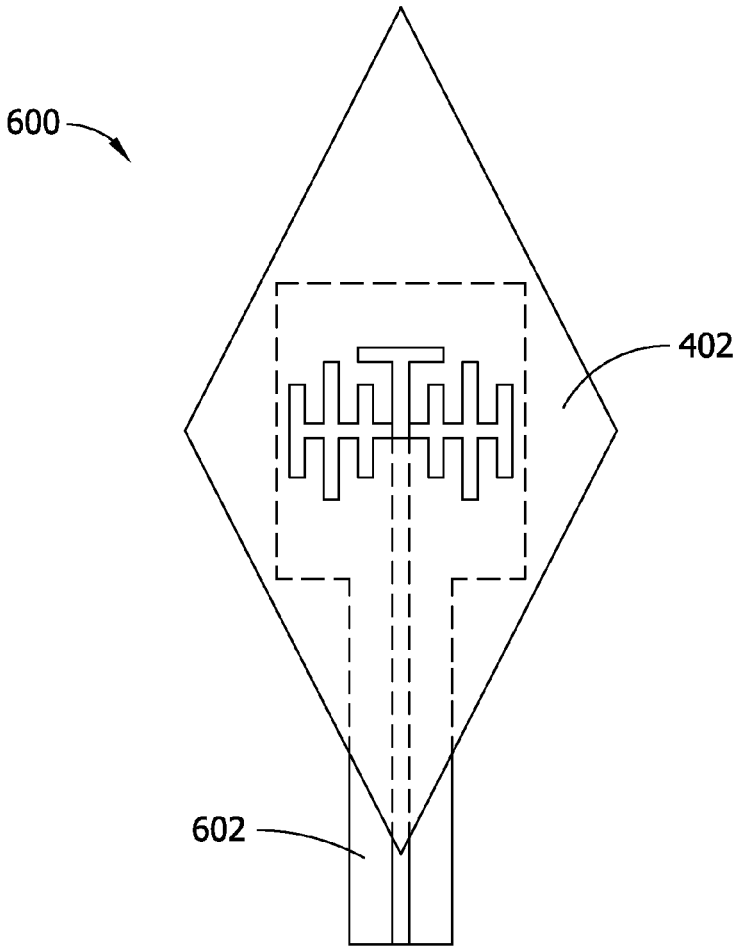
FIG. 6 is a partial top plan view illustrating a ground plane having a stripline feed and a finger slot aperture.

Referring generally to FIGS. 5 and 6, a ground plane layer 500 is illustrated. A ground plane layer 500 may include a ground plane 402 having a finger slot aperture 502. The finger slot aperture 502 may be symmetric. In conjunction with an array of dipoles 202 and metamaterial radiating elements 104, the cross polar radiation may be zero at array normal and in the E plane scan. In FIG. 6, a stripline feed layer 600 is shown with a stripline feed 602 and a ground plane layer 500. A stripline feed 602 may include a strip of metal functioning as transmission media for a stripline fed radiating element. A stripline feed 602 may be placed by etching circuitry on a substrate. In one embodiment, a stripline feed 602 may include an impedance of about 80 ohms for packaging ease. Utilizing a stripline feed 602 may be advantageous for reducing and/or eliminating electromagnetic radiation and back radiation. Further, no tuning features may be required by utilizing an array of dipoles 202 and metamaterial radiating elements 104 and the finger slot aperture 502.

Figure 7:
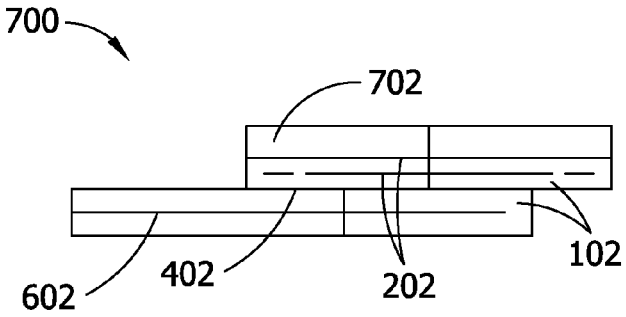
FIG. 7 is a partial cross-sectional view illustrating an embodiment of an array antenna with a radome layer and an embedded metamaterial radiating element.

Referring generally to FIG. 7, an example of an embedded radiating element 700 includes at least one metamaterial radiating element 104, at least one dipole 202, at least one stripline feed 602, a substrate 102, a ground plane 602, and a radome layer 702. The embedded radiating element 700 may be advantageous for use in a benign and/or demanding environment. A radome layer 702 may include a structural, weatherproof protecting layer for shielding an array antenna or other communication equipment from the environment. One example of a radome layer 702 may include an astroquartz layer. Astroquartz may include a fiber and/or fabric made from high purity quartz crystals. Astroquartz may have low dielectric loss properties and may be suitable for use in radome and antenna equipment. Some other examples suitable for use as a radome layer 702 may include fiberglass and/or poly(tetrafluoroethylene) coated fabric. In one embodiment, a low profile planar radiating element may include an embedded radiating element 700 including a plurality of metamaterial radiating elements 104 and a plurality of dipoles 202 in a second level 300 and a first level 200, an Arlon CLTE laminate substrate 102, a ground plane 402 having a finger slot aperture 502, and an astroquartz radome layer 702. The low profile planar radiating element of the current embodiment may be suitable to be utilized and/or embedded in a ship's surface material, military vehicle armor, unmanned aerial system radars, and/or a smart skin, which may include a smart composite containing built-in computers and/or sensors.

Additionally, the metamaterial radiating element suspended in a substrate 100, the first level 200, the second level 300, the metameterial loaded wide scan radiating element 400, the ground plane layer 500, the stripline feed layer 600, and/or the embedded radiating element 700 may be In one embodiment, an embedded radiating element 700 may be utilized in an antenna embedded in a ship's surface material. The embedded radiating element 700 may include a radome layer 702, which may include a 30 mil monolithic astroquartz layer for use with the $K_u$ band. The $K_u$ band may include a portion of the electromagnetic spectrum in the microwave frequencies from 12 to 18 GHz, often used for satellite communication. Additionally, the embedded radiating element 700 may include a substrate 102 including Arlon CLTE with a second level 300 and a first level 200 including an array of metamaterial radiating elements 104 and dipoles 202. In this embodiment, the depth of the planar radiating element including the astroquartz radome layer 702 and the substrate 102 layers is 110 mils. Utilizing a radome layer 702 with an array antenna having an array of metamaterial radiating elements 104 and dipoles 202 may serve to facilitate better communication capability while protecting the array antenna from harsh and damaging elements.

It is believed that the present technology and many of its attendant advantages will be understood from the foregoing description, and it will be apparent that various changes may be made in the form, construction, and arrangement of the components thereof without sacrificing all of its material advantages. The form herein before described being merely explanatory embodiments thereof, it is the intention of the following claims to encompass and include such changes.

What is claimed is:

1. An array antenna, comprising:
a substrate;
an array of dipoles;
an array of metamaterial elements disposed on two planes, including radiating elements suspended in the substrate and integrated and coplanar with the array of dipoles, where the metamaterial elements include a first metal layer substantially planar to a second metal layer;
a ground plane layer coupled with a first side of the substrate, the ground plane having a symmetric finger slot aperture and not contacting the array of metamaterial elements; and
a stripline feed for the radiating elements, where the stripline feed passes from a groundplane first side through the symmetric finger slot aperture to a groundplane second side.

2. The array antenna in claim 1, comprising:
a micro dispersed ceramic poly(tetrafluoroethene) composite substrate utilizing a woven fiberglass reinforcement.

3. The array antenna in claim 1, comprising:
a substrate meeting MIL-STD-810E standards.

4. The array antenna in claim 1, comprising:
an array of stripline fed radiating elements having a dimension at least one of less than or equal to one wavelength.

5. The array antenna in claim 1, comprising:
an array of radiating elements.

6. The array antenna in claim 1, comprising:
a radiating element utilizing a metamaterial having at least one of one or two substrate layers.

7. The array antenna in claim 1, comprising:
a radiating element that is scalable in frequency.

8. The array antenna in claim 1, comprising:
an array of stripline fed radiating elements.

9. The array antenna in claim 1, comprising:
an array of strip dipoles.

10. The array antenna in claim 1, comprising:
a groundplane including at least one finger slot aperture.

11. The array antenna in claim 1, comprising:
a structure including at least two groundplanes.

* * * * *